US005758946A

United States Patent [19]

Chen

[11] Patent Number: 5,758,946

[45] Date of Patent: Jun. 2, 1998

[54] SHOE HEEL HAVING A LIGHT-EMITTING DEVICE

[76] Inventor: Steve Chen, No. 30-35, Yung Hsing Rd., Hsin Tsuo Village, She Tou Hsian, Chang Hua Hsien, Taiwan

[21] Appl. No.: 811,004

[22] Filed: Mar. 4, 1997

[51] Int. Cl.[6] ..... F21L 15/08

[52] U.S. Cl. ..... 362/103; 362/276; 362/191; 36/137

[58] Field of Search ..... 362/103, 276, 362/802, 190, 191; 36/136, 137

[56] References Cited

U.S. PATENT DOCUMENTS

| | | | |
|---|---|---|---|
| 4,158,922 | 6/1979 | Dana, III | 362/103 |
| 5,303,131 | 4/1994 | Wu | 362/103 |
| 5,357,697 | 10/1994 | Lin | 36/137 |
| 5,396,720 | 3/1995 | Hwang et al. | 362/103 |
| 5,419,061 | 5/1995 | Barrocas | 362/103 |
| 5,490,338 | 2/1996 | Hwang et al. | 362/103 |
| 5,644,858 | 7/1997 | Bemis | 362/103 |

*Primary Examiner*—Thomas M. Sember
*Attorney, Agent, or Firm*—Browdy and Neimark

[57] ABSTRACT

A shoe heel is provided with a light-emitting device and composed of a main body, and a transparent heel portion forming the shoe heel along with the main body. The main body has a waist portion, a top portion, a junction located between the waist portion and the top portion, and a receiving slot located in the waist portion for accommodating the light-emitting device. The light-emitting device comprises a battery, a vibration switch, and at least one light-emitting body.

5 Claims, 3 Drawing Sheets

SHOE HEEL HAVING A LIGHT-EMITTING DEVICE

FIELD OF THE INVENTION

The present invention relates generally to a shoe, and more particularly to a high shoe heel provided therein with a light-emitting device.

BACKGROUND OF THE INVENTION

There are certain athletic shoes which are provided in the transparent heel thereof with a light-emitting device capable of giving forth the warning flash. The light-emitting device is housed in a cavity of the transparent shoe heel which is relatively short in height. Such a light-emitting device as described above can not be transplanted to a shoe having a high heel in view of the fact that the light-emitting device can undermine the overall esthetic effect of the shoe.

SUMMARY OF THE INVENTION

The primary objective of the present invention is to provide a high shoe heel with a light-emitting device without undermining the overall esthetic effect of the shoe.

In keeping with the principle of the present invention, the foregoing objective of the present invention is attained by a high shoe heel which is composed of a waist portion, a top portion, a heel portion, and a light-emitting device. The waist portion is provided with a receiving slot in which the light-emitting device is located. The transparent heel portion is located between the waist portion and the top portion such that the light emitted by the device can be seen.

DETAILED DESCRIPTION OF THE INVENTION

Figure 1:
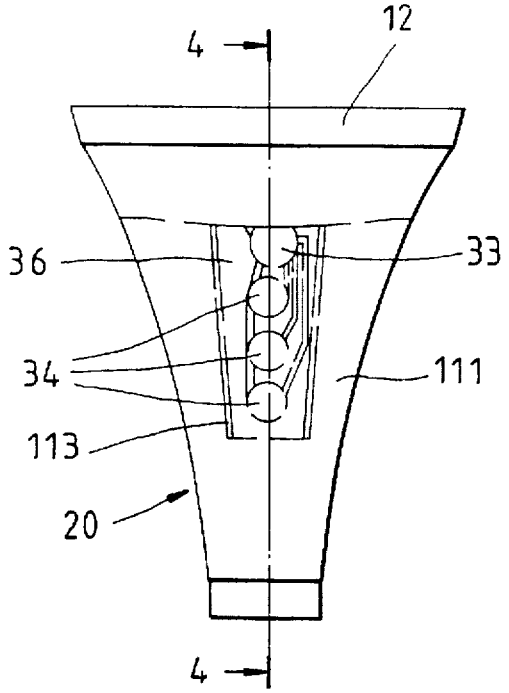
FIG. 1 shows a front elevational view of the present invention.
Figure 2:
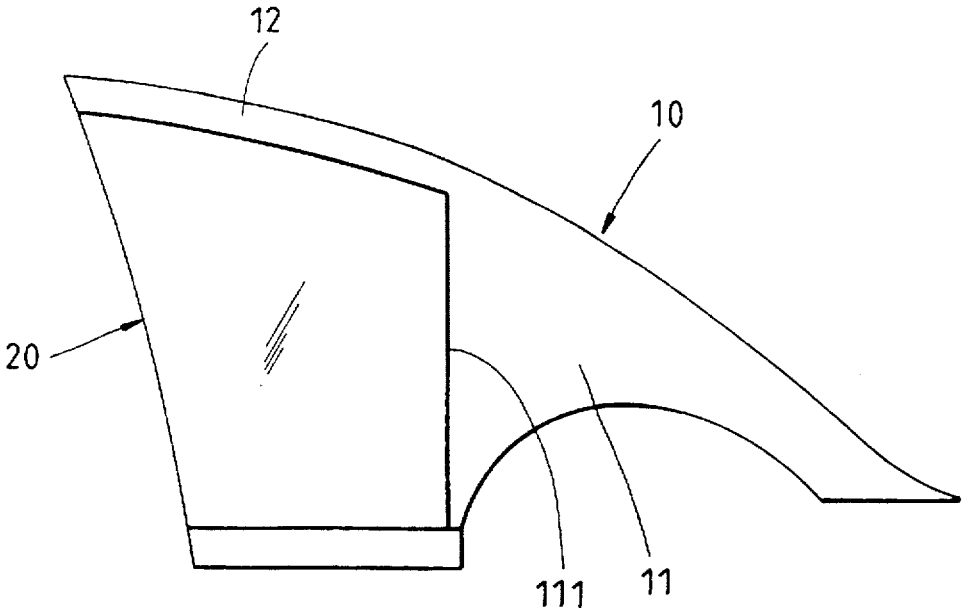
FIG. 2 shows a side elevational view of the present invention.
Figure 3:
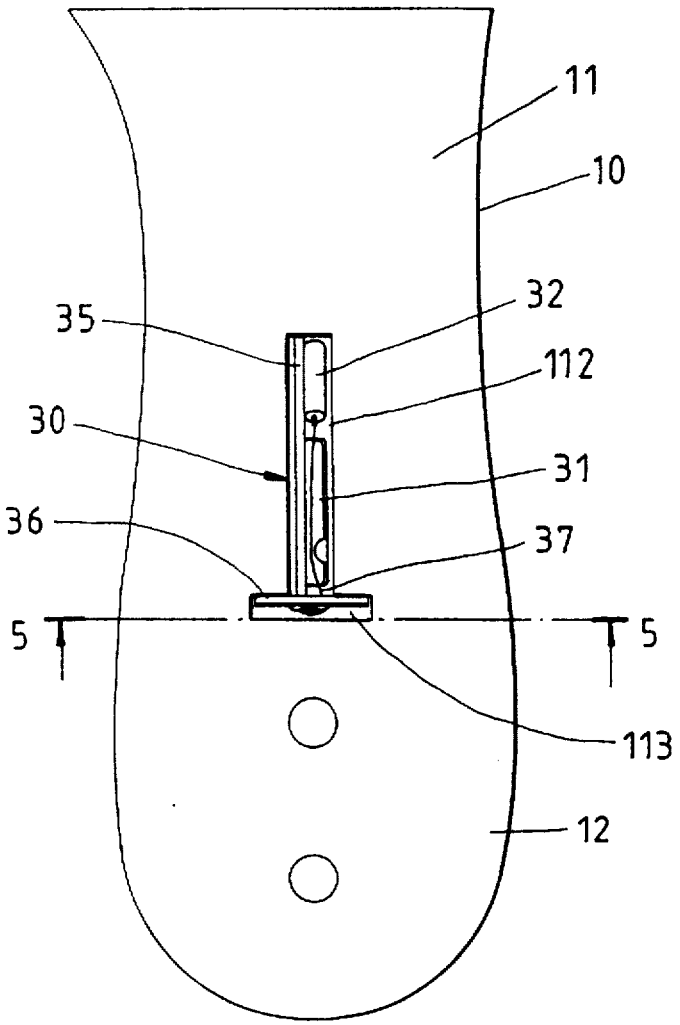
FIG. 3 shows a top plan view of the present invention.
Figure 4:
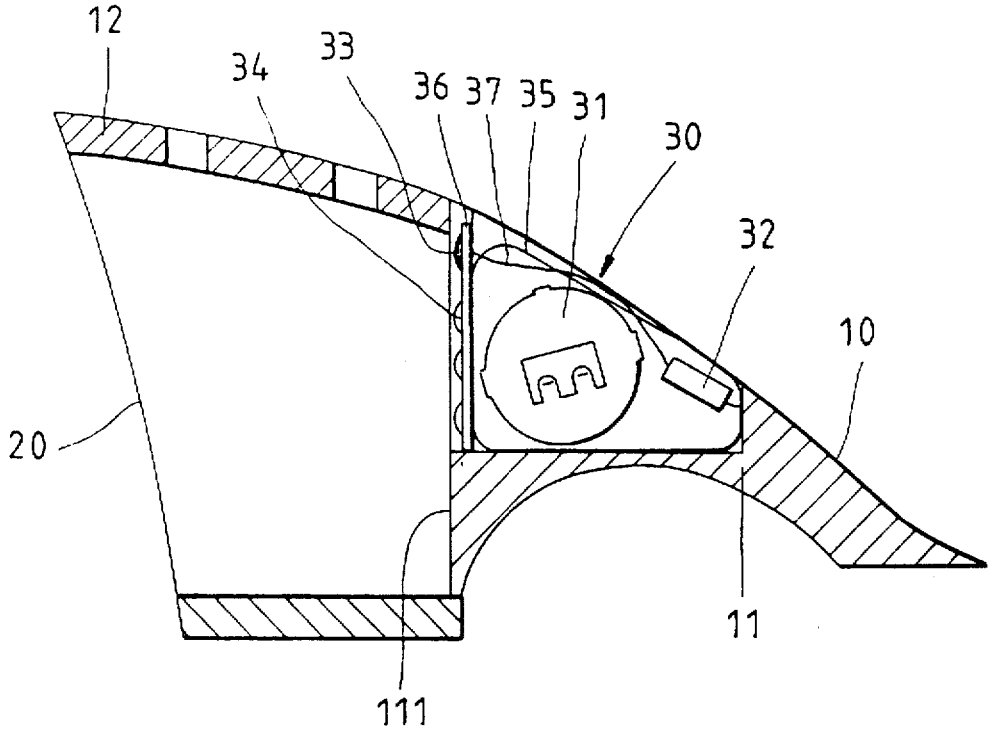
FIG. 4 shows a sectional view of a portion taken along the direction indicated by a line 4—4 as shown in FIG. 1.
Figure 5:
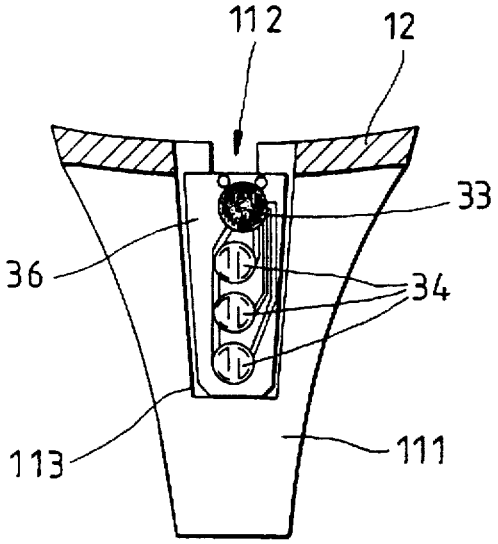
FIG. 5 shows a sectional view of a portion taken along the direction indicated by a line 5—5 as shown in FIG. 3.

As shown in FIGS. 1–5, a high-heeled shoe embodied in the present invention is composed of the component parts, which are described explicitly hereinafter.

A main body 10 comprises a waist portion 1 1 and a top portion 12 which is corresponding in location to the heel of a person wearing the shoe. Located between the waist portion 11 and the top portion 12 is a junction 111. The waist portion 11 is provided with a receiving slot 112 extending from the center of the top of the waist portion 11 towards the bottom thereof. The junction 111 is provided in the center thereof with a cavity 113 which is in communication with the receiving slot 112 such that the cavity 113 and the receiving slot 112 are arranged in a T-shaped configuration in a horizontal section.

A transparent heel portion 20 is located under the top portion 12 such that the heel portion 20 is closely contiguous to the junction 111 of the waist portion 11, and that the heel portion 20 and the main body 10 form together a shoe heel.

A light-emitting device 30 comprises a battery 31, a vibration switch 32, a control integrated circuit 33, and three light-emitting bodies 34. The battery 31 and the vibration switch 32 are mounted on a first circuit board 35, which is located in the receiving slot 112 of the waist portion 11 of the main body 10. The control integrated circuit 33 and the three light-emitting bodies 34 are mounted on a second circuit board 36, which is located in the cavity 113 such that the light-emitting bodies 34 are contiguous to the transparent heel portion 20 and that the circuit board 36 is connected with the circuit board 35 by a wire 37.

As the shoe heel of the present invention is impacted by the foot heel, the light-emitting bodies 34 are triggered to illuminate. The light is capable of passing through the transparent heel portion 20 so as to make the shoe heel of the present invention something that will especially attract one's attention on the occasion of various night events, such as a dance party, a banquet, and so forth.

The present invention is unique in design in that the transparent heel portion 20 is relatively large in dimension to enhance the visual effect of the light-emitting device 30, and that the light-emitting device 30 is concealed in the waist portion 11 to prevent the light-emitting device 30 from undermining the overall esthetic effect of the shoe.

In order to enhance the visual effect of the light-emitting device 30 of the present invention, the light-emitting bodies 34 may comprise illuminating lights of various colors. In addition, the number of the light-emitting bodies 34 is variable.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A shoe heel having a light-emitting device, said shoe heel comprising:

a main body having a waist portion, top portion, a junction located between said waist portion and said top portion, and a receiving slot located in said waist portion;

a transparent heel portion located between said top portion and said waist portion such that said heel portion forms said shoe heel along with said main body;

the light-emitting device located in said receiving slot of said main body and composed of a battery, a vibration switch and at least one light-emitting body;

wherein said waist portion is provided with a cavity at said junction in which said light-emitting body is located:

wherein said cavity is in communication with said receiving slot; and wherein said cavity and said receiving slot are arranged in a T-shaped configuration in a horizontal section.

2. A shoe heel having a light-emitting device, said shoe heel comprising:

a main body having a waist portion, a top portion extending away from an upper surface of said waist portion and a receiving slot extending down through said upper surface between opposite sides of said waist portion;

a transparent heel portion located under said top portion and forming a junction with said waist portion such that said transparent heel portion creates said shoe heel with said main body; and the light-emitting device being located in said receiving slot of said main body apart from said top portion and comprising a battery, a vibration switch and at least one light-emitting body located at said junction.

3. The shoe heel as defined in claim 2, wherein said waist portion is provided with a cavity at said junction in which said light-emitting body is located.

4. The shoe heel as defined in claim 3, wherein said cavity is in communication with said receiving slot.

5. The shoe heel as defined in claim 4, wherein said cavity and said receiving slot are arranged in a T-shaped configuration in a horizontal section.

* * * * *